United States Patent [19]

Schmidt

[11] 4,237,629

[45] Dec. 9, 1980

[54] APPARATUS FOR ACTUATING THE OPERATION OF A SNOWPLOW

[75] Inventor: Alfred Schmidt, St. Blasien, Fed. Rep. of Germany

[73] Assignee: Ing. Alfred Schmidt GmbH, Fed. Rep. of Germany

[21] Appl. No.: 930,932

[22] Filed: Aug. 4, 1978

[30] Foreign Application Priority Data

Aug. 12, 1977 [DE] Fed. Rep. of Germany ..... 2736312

[51] Int. Cl.[3] ..... H01H 21/24; E01H 5/04

[52] U.S. Cl. ..... 37/41; 200/6 A

[58] Field of Search ..... 37/41, 42 R, 42 VL, 37/50; 200/4, 6 A, 16 C, 61.86

[56] References Cited

U.S. PATENT DOCUMENTS

| | | | |
|---|---|---|---|
| 3,056,867 | 10/1962 | Eitel | 200/6 A X |
| 3,293,381 | 12/1966 | Eitel | 200/6 A |
| 3,585,319 | 6/1971 | Payerle | 37/42 R X |
| 3,818,154 | 6/1974 | Presentey | 200/6 A |
| 3,827,313 | 8/1974 | Kiessling | 200/6 A X |
| 4,026,048 | 5/1977 | Hill et al. | 37/42 R |
| 4,057,701 | 11/1977 | Sisk et al. | 200/6 A X |

FOREIGN PATENT DOCUMENTS

| | | | |
|---|---|---|---|
| 675027 | 4/1939 | Fed. Rep. of Germany | 200/6 A |
| 1010136 | 6/1957 | Fed. Rep. of Germany | 200/6 A |
| 1503972 | 12/1967 | France | 200/6 A |
| 2379852 | 2/1977 | France | 37/41 |
| 527308 | 10/1940 | United Kingdom | 200/6 A |
| 1035193 | 7/1966 | United Kingdom | 200/6 A |

*Primary Examiner*—E. H. Eickholt

[57] ABSTRACT

A snow plow having a blade movable by a plurality of drive devices actuated by switch members is controllable by a stick shift having a hand grip at one end and contacts at the other end for engagement with the switch members. The stick shift is pivotal from a neutral position in a selected one of a plurality of paths into engagement with the switch members, and includes in combination with its hand grip two additional switches for controlling at least one additional operation of said blade independently of the position of the stick shift.

13 Claims, 2 Drawing Figures

APPARATUS FOR ACTUATING THE OPERATION OF A SNOWPLOW

The present invention relates to apparatus for controlling the operation of a snow plow and in particular to a manually operable stick shift therefor.

Vehicular type snow plows as for example employed to clean roads, airports or the like have very large plow blades movably supported by hydraulic cylinders. During use, the blade must at times be raised, lowered and adjusted i.e. angled to the right or left for most effective operation. Since the operator is also charged with safely operating the vehicle, suitable means for controlling the movement of the blade must be provided. To this end, four position gate type shift mechanism are known having a stick shift movable from a neutral position (N) into one of four positions thereby causing contact with electrical switch means controlling the drive means for/or the hydraulic cylinders activating the plow. In this manner, the plow may be raised (R), lowered (L), adjusted right (AR) or adjusted left (AL) as may be desired. However, these known constructions have the serious disadvantage that additional operations such as providing "plow under dead weight" (P) can only be effected by the use of a gate type gear shift mechanism having more than four shift paths for the use of auxiliary controls separate from the shift mechanism. A gate type gear shift of more than four paths is extremely expensive and further more rules out the ability to simultaneously control the basic movement of the plow and the additional operation thereon. Auxiliary controls, independent of the gate type shift mechanism make it more difficult to operate the snow plow and particularly require that the operator's eye be removed from the road.

In addition to the above mentioned additional operation of "plowing under dead weight" which is synonymous to the float position of the vertical cylinders supporting the plow, the operation "unlock in adjust direction" is of special importance. This additional operation is synonymous with a float position of the hydraulic cylinders for the lateral adjustment of the blade. Practical handling of the snow plow requires that these two additional operations "plowing under dead weight" and "unlocking in adjust direction" be controllable simultaneously together with certain operations calling for the movement of the plow.

The present invention provides a shift arrangement utilizing the gate type shift apparatus mentioned above so that additional operations can be performed which overlap certain of the basic movement operations and which can be controllable by the operator without the requirement for visually locating the controls. Thus, any operator mistakes which may very easily lead to damage of the snow plow can be obviated.

According to the present invention, control elements for two additional operations, such as "plow under dead weight" (P) and "unlock in adjust direction" (U) combined with the hand grip of a stick shift. This enables two additional operations P and U to be accomplished by the driver in a blind manner and with the hand embracing only the stick shift. It enables the driver, in order to avoid constraints of the blade suspension, to control the operational movements by adjust left and adjust right simultaneously with the operation "plow under dead weight" and the operation "unlock in adjust direction" simultaneously with the operation of raising and lowering the blade.

According to the present invention, the shift apparatus is designed so that the operation associated with each shift path remains engaged only so long as the stick shift is held in that position. Preferably one of the additional control elements is a hand grip mounted to be shiftable along the axis of the stick shift while the other one of the control elements is a push button capable of being actuated by the thumb of the operator while the operator is manually holding the stick shift. Both these control means are resiliently biased so that they are in actuating position only so long as the operator exerts an actuating force thereon. Both these control members are designed to operate a pulse switch providing the necessary signal for control of the drive means effecting the particular plow operation.

Further, in accordance with the present invention the stick shift mechanism has a novel design so that it is also resiliently biased mainly in engaged position only so long as the operator maintains the stick shift in that position and is automatically returned to the neutral position once the operator releases control thereof.

The full details of the present invention are set forth in the following description and are shown in the accompanying drawings.

Figure 1:
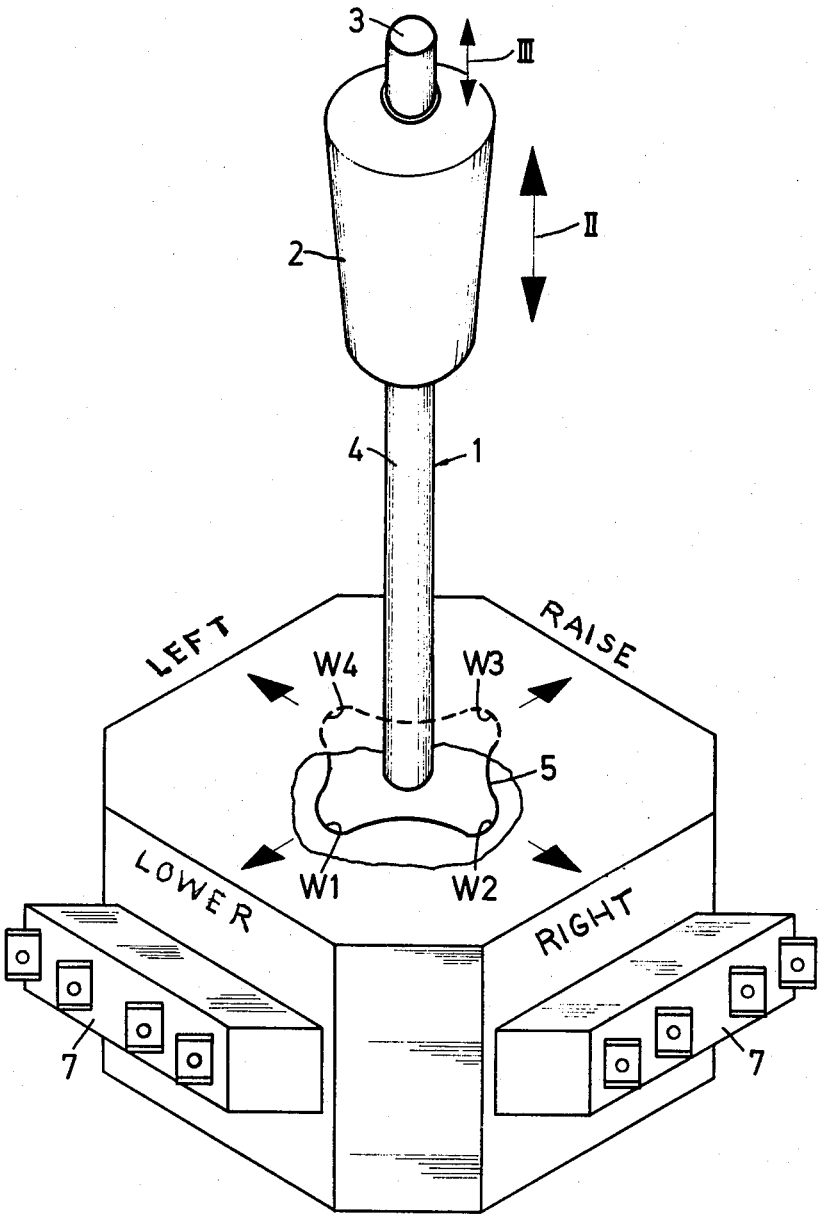
FIG. 1 is a perspective view of a shift apparatus embodying the present invention.

As seen in FIG. 1, the shift arrangement briefly comprises a control or stick shift, generally depicted by the numeral 1, comprising an elongated rod 4 set in a slide block 5 mounted on the upper surface of a generally rectangular housing 6. The interior of the housing 6 contains four sets of electric contacts the terminals 7 of which extend through the outer side faces for connection by electric lines to the conventional control members of those drive means necessary for actuation of the individual operations, (for example, electric or hydraulic motors or cylinders). The stick 4 is pivotable in four shift paths $W_1$–$W_4$ so that its inner end makes selective engagement with the necessary electric contacts to effect the operations left, right, raise, lower, as indicated in FIG. 1.

At its upper end of the rod 4, the stick shift 1 is provided with a slideable hand grip 2, in the top end face of which is mounted a push button 3. The hand grip 2 is mounted so as to slide axially of the rod along path II and its downward movement is designed to effect on addition operation as for example "plow under dead weight" (P). The push button 3 is mounted so as to be depressable into the end of the rod 4 along path III and on its downward movement is designed to effect a second additional operation such as "unlock in adjust direction" (U).

Figure 2:
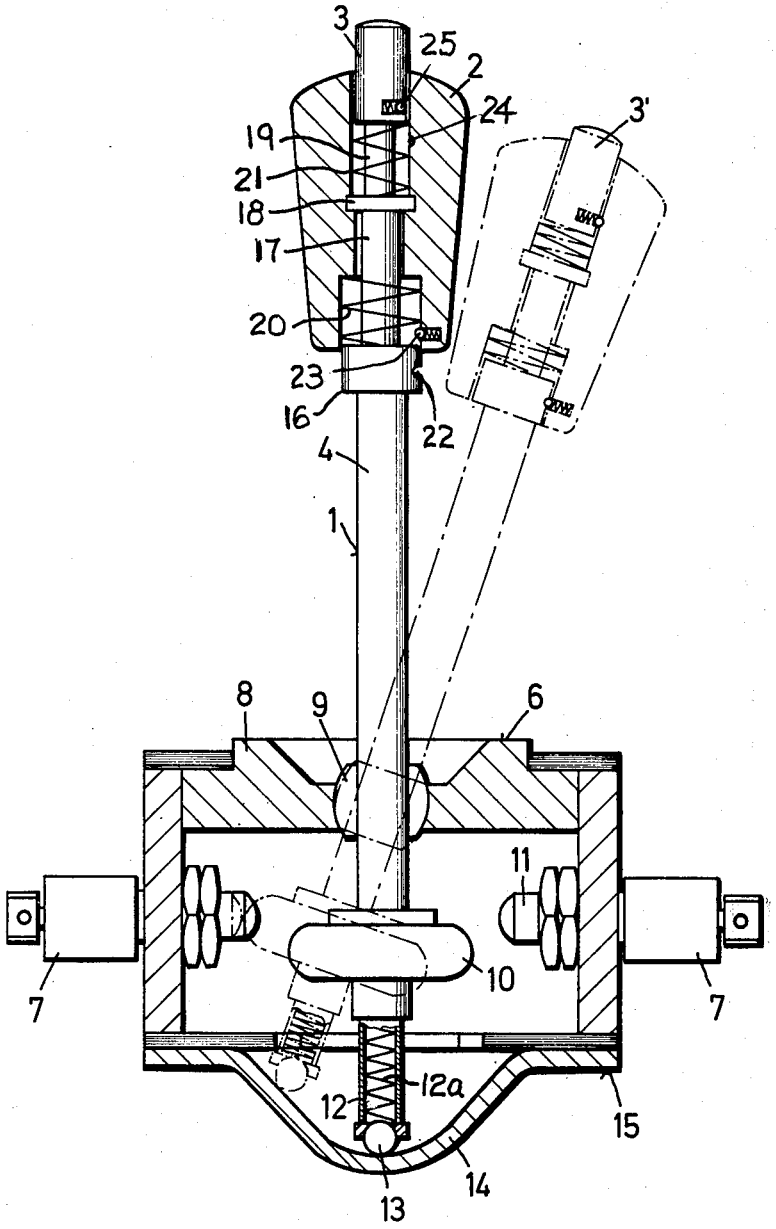
FIG. 2 is a sectional view through the arrangement of FIG. 1.

The detail construction of the shift arrangement is shown clearly in the sectional view of FIG. 2. The housing 6 is formed with a plurality of side walls having a cover 8 in which is formed a central bore, through which the rod 4 extends. The bore has a conically outward tapered upper section and a central cylindrical lower section. A rubber, plastic or other elastic material ball joint ring 9 fits over the rod 4 and journals the rod within the lower section of the bore for substantially universal movement therein. The bottom of the housing is closed by a wall 15, having a central outwardly domed section 14 surrounded by a peripheral flange which is secured to the side walls of the housing. Suitable gasket seal and insulating members are inserted between the bottom wall 15 and the side walls as well as between the top covers and side walls.

The lower end of the rod 4, is provided with a hollow section in which is slideably inserted a tubular sleeve 12 mounting a ball 13 at its outer end. The sleeve 12 and ball 13 are biased outwardly by a compression spring 12*a* the inner end of which abuts against a stop or wall within rod 4, so that the ball 13 is caused to normally side on the inner surface of the dome portion 14 of the bottom wall.

Fixedly mounted on the rod 4 within the housing 6 is a doughnut or annular shaped contact ring 10. Secured through the side walls slightly above the contact ring 10 are the contact buttons of normally open spring biased push button switches 11 to which the terminal 7 are connected.

Upon deflection of the rod 4, about the pivot point formed by the journal 9 shown in dotted lines, the annular ring 10 is caused to push, and thereby actuate a selected contact 11. Automatic return of the stick 4, to its neutral position is assured by the interaction of the ball 13 on the domed surface 14. Thus, the activation of any one of the contacts lasts only so long as the operator holds the stick in the selected position.

The upper end of the rod 4 is provided with an annular collar 16 and a hollow axial section in which a first plunger 17 fits. The first plunger 17 is itself provided with an annular collar 18 and is also hollow receiving a second plunger 19 to which the push button 3 is secured. The hand grip has a central bore of varying diametric sections. The lower section contains a compression spring 20 abutting against the collar 16 and an inner shoulder acting to normally bias the hand grip axially upward of the stick 4. The upper section of the hand grip bore contains a similar spring 21 abutting against the collar 18 and the push button to normally bias the push button upwardly.

Cooperative contact members 22 and 23 are formed on the lower collar 16 and the lower end of the hand grip respectively which engage on the depression of the hand grip. Cooperative contacts 24 and 25 are formed on the upper portion of the hand grip and the push button 3 which engage on the depression of the push button. Preferably, the contacts 23 and 25 are spring load balls permitting the grip and push button relatively free movement while insuring positive detent contact. Suitable electrical line connections from the contacts extend through the grip, push button, plunger and rod into the housing 6, and there to one of the exterior terminals 7 to means for providing an electrical pulse signal to the associated drive means. Because of the spring loading of the hand grip 2 and the push button 3, those contacts controlled by them can only remain engaged so long as the operator dispenses the respective grip or button and once these are let go, the contacts return immediately and automatically to the neutral or open position.

It will be seen from the foregoing that application of the hand grip and push button are independent of each other as well as independent of the gate type gear shift actuated by pivotal movement of the rod 4. All actions require a positive movement on the part of the operator and end in an automatic return to neutral position once this positive action ends. While the operation of the hand grip control element may be independent of the operation of the switches in the housing, suitable interlocks, either mechanical or electrical can be supplied so that certain operations can be accomplished simultaneously or mutually excluded. Namely it may be desired to provide an interlock by which the "adjust right and left" (AR) (AL) is obtained automatically with the "plow under dead weight" (P) and where the "unlock in adjust direction" (U) is also effected simultaneously with the raise (R) and lower (L) but where the "plow" (P) is annulled on raising or lowering the blade.

Various embodiments, modifications and changes have been suggested herein and others will be obvious to those skilled in this art. It is therefore intended that the present disclosure be taken only as illustrative and not limiting of the present invention.

What is claimed is:

1. Apparatus for controlling the operation of a snow plow having a blade movable by drive means actuated by switch members, comprising a stick shift having a hand grip at one end and means at the other end for engagement with said switch members, said stick shift being pivotal from a neutral position in a selected one of a plurality of paths into engagement with the switch members, said switch members being connected to said drive means for respectively "raising", "lowering", "adjusting to the right", and "adjusting to the left" said blade and including two additional switch means in combination with said hand grip for controlling at least one additional operation for "plowing under dead weight" and "unlock in adjusting direction" of said blade independently of the position of the stick shift.

2. The apparatus for controlling the operation of a snow plow according to claim 1, wherein said switch members have normally open contacts and remain connected so long as said stick shift is in engagement therewith.

3. The apparatus for controlling the operation of a snow plow according to claim 2, including spring means for normally biasing said stick shift in neutral position and causing automatic return to said neutral position on release of said stick shift.

4. The apparatus according to claim 1, wherein said hand grip switch means is a push button mounted on said hand grip.

5. The apparatus according to claim 4, wherein the push button is a thumb knob mounted on the top end of the hand grip, for thumb operation.

6. The apparatus according to claim 4, wherein the push button has a normally open contact and remains connected as long as the actuating force acts thereon.

7. The apparatus according to claim 6, including spring means for normally biasing in open position said push button and causing automatic return to open contact position on release of said push button.

8. The apparatus according to claim 1 or 4, wherein said hand grip is displaceable axially along said stick shift and said hand grip switch means includes cooperable contacts actuatable by displacement of the hand grip.

9. The apparatus according to claim 8, wherein said hand grip is movable between a first position in which said contacts are disengaged and a second position wherein said contacts are engaged.

10. The apparatus according to claim 9, including spring means for normally biasing said hand grip in said first position and for automatically returning said hand grip to said first position on release thereof.

11. The apparatus according to claim 1, including means for effecting the operation of "adjust" (AR, AL) simultaneously with the operation "plow" (P).

12. The apparatus according to claim 1, including means for automatically annulling the operation "plow" (P) upon actuation of the operations "raise" (R) or "lower" (L).

13. The apparatus according to claim 1, including means for controlling the operation of "unlock in adjust direction" (U) simultaneously with the operations "raise" (R) and "lower" (L).

* * * * *